US009375925B2

(12) United States Patent
Shimizu et al.

(10) Patent No.: US 9,375,925 B2
(45) Date of Patent: Jun. 28, 2016

(54) LIQUID-EJECTION HEAD AND IMAGE FORMING APPARATUS

(71) Applicants: Takeshi Shimizu, Kanagawa (JP); Tomohiko Kohda, Ibaraki (JP); Takahiro Yoshida, Ibaraki (JP); Kanshi Abe, Ibaraki (JP); Shiomi Andou, Kanagawa (JP); Takayuki Nakai, Kanagawa (JP); Ryo Kasahara, Kanagawa (JP)

(72) Inventors: Takeshi Shimizu, Kanagawa (JP); Tomohiko Kohda, Ibaraki (JP); Takahiro Yoshida, Ibaraki (JP); Kanshi Abe, Ibaraki (JP); Shiomi Andou, Kanagawa (JP); Takayuki Nakai, Kanagawa (JP); Ryo Kasahara, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/855,920

(22) Filed: Sep. 16, 2015

(65) Prior Publication Data

US 2016/0096369 A1 Apr. 7, 2016

(30) Foreign Application Priority Data

Oct. 7, 2014 (JP) ..... 2014-206565

(51) Int. Cl.
*B41J 2/045* (2006.01)
*B41J 2/14* (2006.01)

(52) U.S. Cl.
CPC ..... *B41J 2/14274* (2013.01); *B41J 2/14233* (2013.01)

(58) Field of Classification Search
None
See application file for complete search history.

(56) References Cited

U.S. PATENT DOCUMENTS 6,361,152 B1 * 3/2002 Fujisawa ..... B41J 2/14274 347/68
2011/0250403 A1 * 10/2011 Higginson ..... B41J 2/161 428/172

FOREIGN PATENT DOCUMENTS

JP 2003-276207 9/2003
JP 5515469 6/2014

* cited by examiner

*Primary Examiner* — Lisa M Solomon
(74) *Attorney, Agent, or Firm* — Cooper & Dunham LLP

(57) ABSTRACT

A disclosed liquid-ejection head for ejecting liquid droplets includes a substrate having a diaphragm forming a part of walls of a pressure liquid chamber, and a piezoelectric element adhered to the substrate with adhesive, and configured to apply pressure to the pressure liquid chamber via the diaphragm. The piezoelectric element has a surface facing the substrate having the diaphragm, and the surface has one or more projection parts in an area in which the pressure liquid chamber is not disposed, and whereon the substrate having the diaphragm has one or more recess parts that fit in the respective projection parts.

7 Claims, 8 Drawing Sheets

LIQUID-EJECTION HEAD AND IMAGE FORMING APPARATUS

BACKGROUND OF THE INVENTION

1. Field of the Invention

The disclosures herein generally relate to a liquid-ejection head and an image forming apparatus.

2. Description of the Related Art

There is known in the related art a liquid-ejection head for use in image forming apparatuses such as printers, facsimile machines, etc. Such a liquid-ejection head is provided with piezoelectric elements, a diaphragm, and a pressure liquid chamber such that the piezoelectric element applies pressure to the pressure liquid chamber via the diaphragm to cause the liquid-ejection head to eject liquid droplets.

In the liquid-ejection head having such a configuration, the diaphragm and the piezoelectric element forming the pressure liquid chamber need to be located and bonded with high precision. Bonding adhesive is generally used for bonding the diaphragm and the piezoelectric elements; however, this type of adhesive does not have fast curability. Hence, in general, the diaphragm and the piezoelectric elements are temporarily adhered with fast-curing adhesive. As a related-art technology for preventing bonding adhesive and the fast-curing adhesive from mixing, a level difference is formed in one of the diaphragm and the piezoelectric elements at positions (e.g., end parts) to which bonding adhesive is not applied, and the fast-curing adhesive is applied to the level differentiated positions so as to temporarily fix the diaphragm and the piezoelectric elements.

Japanese Laid-open Patent Publication No. 2003-276207 (hereinafter referred to as "Patent Document 1"), for example, discloses an example of such technology for preventing the bonding adhesive and the fast-curing adhesive from mixing. In this technology, for the purpose of obtaining initial adhesive strength at the temporary fixing, a recess part is formed in an area of the diaphragm that faces an area of the piezoelectric elements to which the bonding adhesive is not applied, and the diaphragm and the piezoelectric elements are fixed by applying the fast-curing adhesive to the recess part.

However, in the disclosed related art technologies to temporarily fix the diaphragm and the piezoelectric elements, the pressure liquid chamber includes components of different materials; these are such as a nozzle plate, a liquid chamber plate, and a diaphragm, which are adhered in layers. Accordingly, the components may deform by warping along with the differences in the linear expansion coefficients for different materials, and the diaphragm and the piezoelectric elements may be adhesively fixed while the diaphragm undergoes warping deformation. Further, in some cases, each of the components may have warping deformation, and the components each having warping deformation may be adhered in layers. Japanese Patent No. 2003-276207 (hereinafter referred to as "Patent Document 2"), for example, discloses a technology to improve the precision of the components by press-processing a metallic plate of one of channel plates; however, the plates may warp after the processing.

As a result, the end parts and the central parts of the piezoelectric elements may be adhered to the diaphragm having warping deformation. This may cause the difference in pressure application while bonding the piezoelectric elements and the diaphragm, leading to heterogeneous bonding at the end parts of the piezoelectric elements and the diaphragm. Moreover, the bonding state of the pressure liquid chamber at the end parts of the piezoelectric elements may also be affected, and thus, characteristics variability may occur such as ink-ejection speeds varying at different deposited positions.

RELATED ART DOCUMENT

Patent Document

Patent Document 1: Japanese Laid-open Patent Publication No. 2003-276207

Patent Document 2: Japanese Patent No. 5515469

SUMMARY OF THE INVENTION

Accordingly, it is a general object in one embodiment of the present invention to provide a liquid-ejection head capable of preventing bonding adhesive from mixing with fast-curing adhesive for bonding a diaphragm, a substrate having the diaphragm, and piezoelectric elements, and preventing bonding heterogeneity between the piezoelectric elements and the diaphragm disposed near an end part of a pressure liquid chamber, which substantially obviate one or more problems caused by the limitations and disadvantages of the related art.

According to an aspect of embodiments, there is provided a liquid-ejection head for ejecting liquid droplets that includes a substrate having a diaphragm forming a part of walls of a pressure liquid chamber; and a piezoelectric element adhered to the substrate with adhesive, and configured to apply pressure to the pressure liquid chamber via the diaphragm. In the liquid-ejection head, the piezoelectric element has a surface facing the substrate having the diaphragm, and the surface has one or more projection parts in an area in which the pressure liquid chamber is not disposed, and whereon the substrate having the diaphragm has one or more recess parts that fit in the respective projection parts.

Other objects, features and advantages of the present invention will become more apparent from the following detailed description when read in conjunction with the accompanying drawings.

DETAILED DESCRIPTION OF THE PREFERRED EMBODIMENTS

In the following, a description is given, with reference to the accompanying drawings of a liquid-ejection head and an image forming apparatus according to an embodiment. Note that the present invention is not limited to embodiments or examples specifically described below. Various alterations and modifications such as addition, correction, or deletion may be made without departing from the scope of the claimed invention anticipated by those skilled in the art, and any aspects of the embodiments that exhibits effective properties may be subject to inclusion within the scope of the claimed invention.

Liquid-Ejection Head

Overall Configuration of Liquid-Ejection Head

Figure 1:
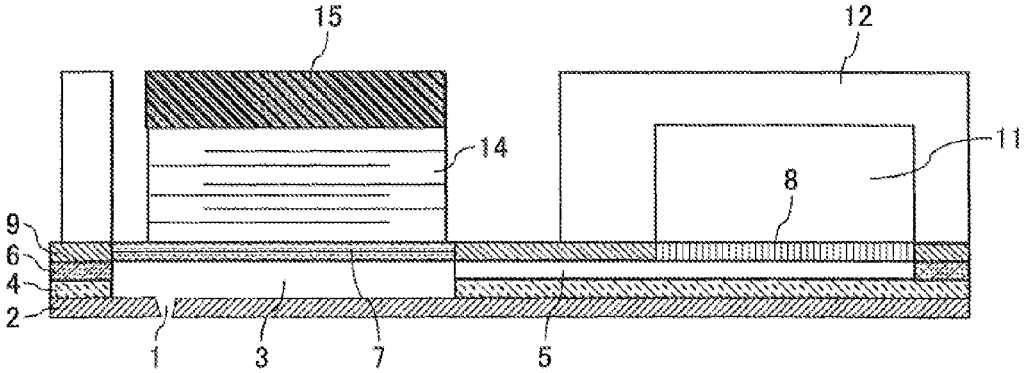
FIG. 1 is a sectional side diagram illustrating an example of a liquid-ejection head.
Figure 2:
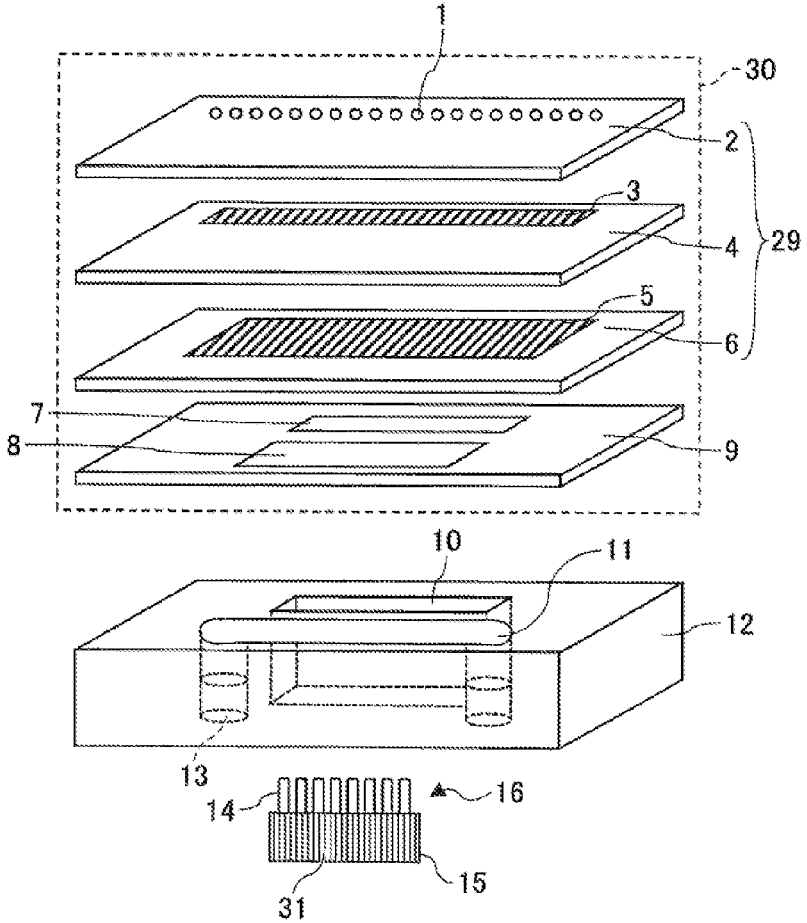
FIG. 2 is a perspective diagram illustrating a main part of the example of the liquid-ejection head in one embodiment.
Figure 3:
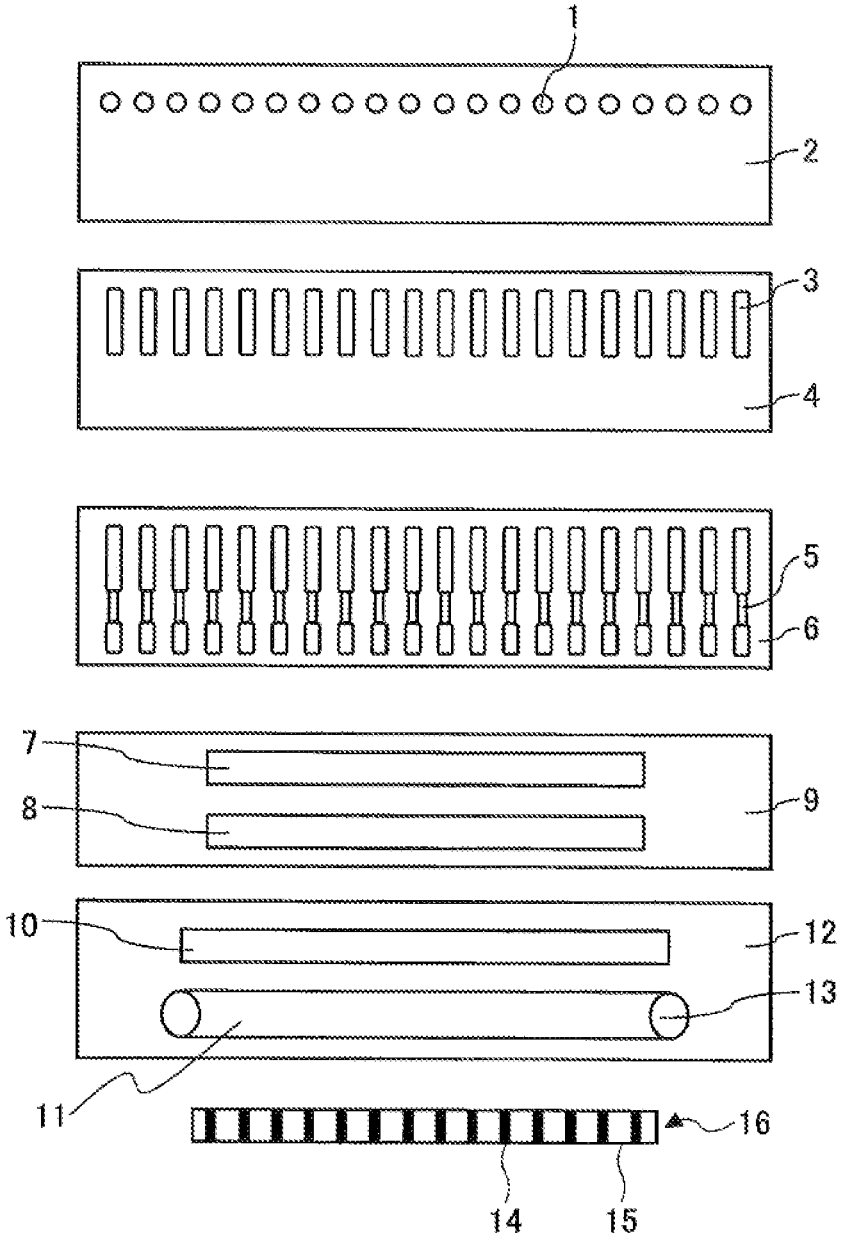
FIG. 3 is a schematic plan diagram illustrating the main part in the example of the liquid-ejection head viewing from a nozzle side.

Initially, a description is given of an example of an overall configuration of a liquid-ejection head according an embodiment with reference to FIGS. 1 to 3. The liquid-ejection head according the embodiment includes a substrate having a diaphragm forming a part of walls of a pressure liquid chamber, and being bonded to a piezoelectric element with adhesive. The liquid-ejection head having this configuration is configured to eject liquid droplets by applying pressure to the pressure liquid chamber via the diaphragm.

FIG. 1 is a sectional side diagram illustrating an example of the liquid-ejection head. FIG. 1 illustrates a nozzle 1, an orifice plate 2, a pressure liquid chamber 3, a chamber plate 4, an individual supply channel 5, a restrictor plate 6, a diaphragm 7, a filter 8, a diaphragm plate 9, a common ink supply channel 11, a frame 12, a piezoelectric element 14, and a base member 15. The diaphragm 7 vibrates by the displacement of the piezoelectric element 14, which changes the pressure in the pressure liquid chamber 3. As a result, liquid droplets are ejected from the nozzle 1. Further, the common ink supply channel 11 is configured to be in communications with the individual supply channel 5 via the filter 8 to supply ink to the pressure liquid chamber 3.

FIG. 2 is a perspective diagram illustrating a main part of the example of the liquid-ejection head, and FIG. 3 is a schematic plan diagram illustrating the main part of the example of the liquid-ejection head as viewed from a nozzle side. FIGS. 2 and 3 depict the orifice plate 2, the pressure liquid chambers 3, the chamber plate 4, the restrictor plate 6, the diaphragm 7, the filter 8, the diaphragm plate 9, and a piezoelectric actuator 16. As illustrated in FIGS. 2 and 3, the orifice plate 2 includes multiple nozzles 1 in an array, and the chamber plate 4 includes multiple pressure liquid chambers 3. The restrictor plate 6 includes multiple individual supply channels 5 connected to the common ink supply channel 11 and the pressure liquid chambers 3 so as to control ink flowing into the pressure liquid chambers 3. The diaphragm plate 9 includes the diaphragm 7 configured to efficiently propagate the displacement of the piezoelectric elements 14 to the pressure liquid chambers 3. The diaphragm plate 9 further includes the filter 8 composed of multiple pores in an area facing the common ink supply channel 11. Note that the diaphragm plate 9 is an embodiment of "a substrate having a diaphragm", and may preferably have elasticity.

In the following description, the orifice plate 2, the chamber plate 4, and the restrictor plate 6 may be generically named as a channel plate 29. Further, a combination of the orifice plate 2, the chamber plate 4, the restrictor plate 6, and the diaphragm plate 9 may be generically named as a channel unit 30. That is, a channel may represent a unit having one nozzle 1 and one pressure liquid chamber 3 corresponding to the nozzle 1.

In the liquid-ejection head, accuracy in opening shapes of processing the nozzles 1, the pressure liquid chamber 3, and the individual supply channel 5 may significantly affect ink-ejection properties of the liquid-ejection head. Hence, high processing accuracy may be required in a method of producing the channel plate 29 in order to lower variability in the channel accuracy between the channels.

Patent Document 2 proposes, for example, that the channel plate 29 may be formed by press-processing a metallic plate in order to improve the processing accuracy. An example of the press-processing of the metallic plate may include stainless-steel precision press-processing, and the like. The precision press-processing is not susceptible to thermal effects such as thermal expansion and thermal shrinkage, and may thus form each of the channels with high position accuracy compared to other processing methods such as metallic etching and electroforming. However, when press-processing the metallic plate, a shearing force may be applied to the channel plate 29 due to press-processing the metallic plate, which may warp or deflect the plate. When there is variability in the warping, deflection, or deformation, sufficient uniformity may fail to be obtained in the combination of the diaphragm 7 and the piezoelectric elements 14.

In the liquid-ejection head formed by stacking multiple members as illustrated in FIGS. 2 and 3, it is preferable that at least one of those members forming the pressure liquid chambers 3 be formed by press-processing the metallic plate. In this method, each of the channels may be formed with high position accuracy. As a detailed description is given later with reference to FIGS. 4A to 4C, the diaphragm 7 and the piezoelectric elements 14 may be well bonded even when the warping or deflection is obtained due to press-processing the metallic plate in this embodiment. Note that in the example in FIGS. 2 and 3, the chamber plate 4, and the restrictor plate 6 may serve as members forming the pressure liquid chambers 3.

The diaphragm plate 9 includes a diaphragm 7 forming a part of its outer periphery in contact with the piezoelectric elements 14 as a thin film part or a movable part of its outer periphery as a thin film part in order to efficiently propagate the displacement of the piezoelectric elements 14. The diaphragm 7 is disposed in each of the channels. The thickness of the thin film parts of the diaphragm 7 may preferably be in a range of 2 to 10 μm. The diaphragm plate 9 and the diaphragm 7 may be produced by nickel electroforming, half-etching a stainless-steel plate, etching a stacking plate of polyimide and stainless-steel, or the like. The production methods of the diaphragm plate 9 and the diaphragm 7 in this embodiment are not particularly limited to the above-described methods; however, the production methods of the diaphragm plate 9 and the diaphragm 7 may preferably be the electroforming method.

The frame 12 includes the piezoelectric actuator inserting opening part 10, and the common ink supply channel 11. The frame 12 includes an ink introducing part 13 connecting from an ink tank to the common ink supply channel 11. The frame 12 may be formed by cutting a stainless-steel material or molding a resin material. Further, although the piezoelectric actuator inserting opening part 10 of the frame 12 appears to be a large opening in FIG. 2, the piezoelectric actuator inserting opening part 10 may include openings forming respective partitions for the piezoelectric elements 14. In such a configuration, so-called crosstalk indicating mutual interference occurring between the multiple channels when driven may be lowered by increasing rigidity of the frame 12.

The piezoelectric actuator 16 includes multiple of the piezoelectric elements 14 and the base member 15 to which the piezoelectric elements 14 are fixed. The piezoelectric elements 14 are disposed with respect to the pressure liquid chambers 3, the diaphragm 7, and the diaphragm plate 9, and one end surfaces of the piezoelectric elements 14 are attached to the diaphragm 7. The piezoelectric elements 14 are not limited to any particular type; however, a multi-layer piezoelectric elements may be used. The multi-layer piezoelectric elements are not limited to any particular type; however, the multi-layer piezoelectric elements may be formed by alternately layering internal electrodes formed of a lead zirconate-titanate (PZT) layer having a thickness range of 10 to 50 μm and a silver palladium layer having a thickness range of several μm.

It is preferable that guide holes be disposed at opposite ends of each of the base member 15 of a piezoelectric actuator 16 and the channel unit 30. In such a configuration, the channel unit 30 and the piezoelectric actuator 16 are formed by precision processing, temporarily connected by locating pins, and subsequently bonded, thereby accurately assembling the channel unit 30 and the piezoelectric actuator 16.

Each of the piezoelectric elements 14 includes an individual electrode 31 and a common electrode for transmitting electric signals independently from an external drive circuit, and the individual electrodes 31 are connected to a cable of the external drive circuit. Electric signals may be selectively applied from the external drive circuit to the piezoelectric elements 14 via these electrodes, and the piezoelectric elements 14 generate distortion. Since the piezoelectric elements 14 are held by the base member 15, the piezoelectric elements 14 preferentially displace the diaphragm 7, which raises the pressure in the pressure liquid chambers 3 to eject liquid droplets.

The principle of a process of ejecting liquid droplets from the liquid-ejection head is as described above, the liquid-ejection head may be employed in apparatuses configured to form ink images on a recording medium.

Figure 4A:
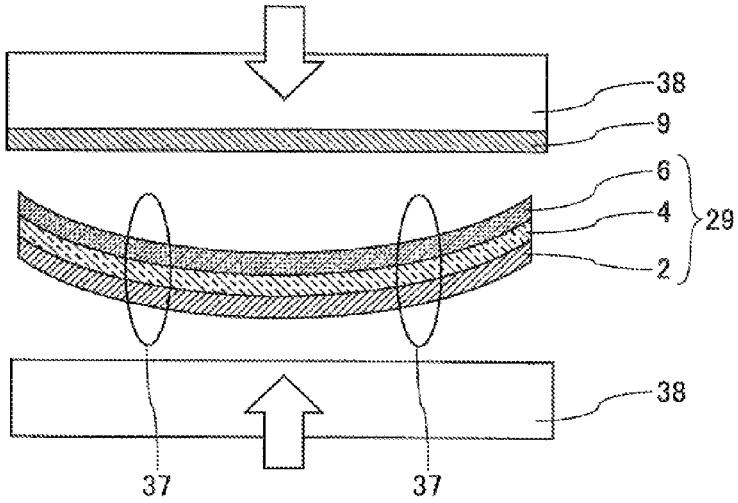
FIGS. 4A to 4C are schematic diagrams illustrating an example of a bonding step of a channel unit, a piezoelectric actuator, and a frame in the example of the liquid-ejection head.
Figure 4B:
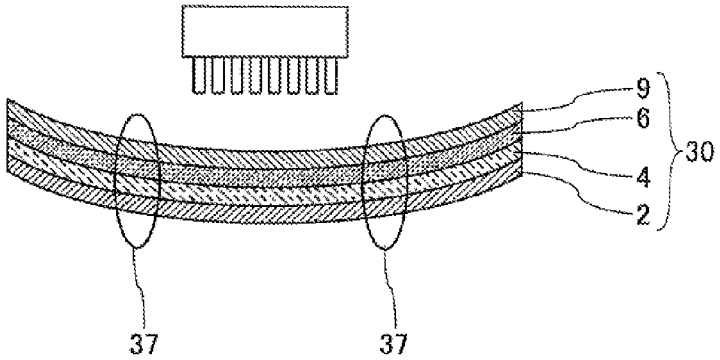
Figure 4C:
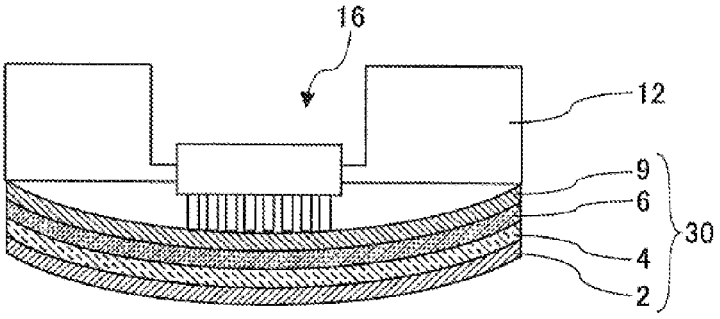

FIGS. 4A to 4C are schematic diagrams illustrating an example of a bonding step of a channel unit, a piezoelectric actuator, and a frame in the example of the liquid-ejection head. The bonding step includes a channel unit bonding step (FIG. 4A), an actuator bonding step (FIG. 4B), and a frame bonding step (FIG. 4C).

As illustrated in FIG. 4A, the channel unit 30 is formed by layering each of the plates (the orifice plate 2, the chamber plate 4, the restrictor plate 6, and the diaphragm plate 9) while applying pressure to the plates using a rigid pressure fixture 38 having the assured flatness, thereby adhering the layered plates. An arrow in FIG. 4A schematically illustrates a direction of pressure applied by the pressure fixture 38. In this example, the respective plates are layered in identical flexure directions. The plates are layered in such directions so as to prevent leakage within an ink channel. This is because when the plates are layered in mutually opposite directions, gaps may be formed between the plates, thereby allowing ink leaking within the ink channel.

FIG. 4A schematically illustrates inflection points 37 of the plates. The outer side of the inflection points 37 may be flattened by the pressure fixture 38 to some extent. However, this flatness outside the flection points 37 is not necessarily sufficient to cause bonding with the piezoelectric actuator 16. However, the parts of the plates that are in contact with the piezoelectric actuator 16 may be flattened by locating the inflection points 37 outside the piezoelectric actuator 16, as illustrated in FIG. 4B. As a result, the diaphragm plate 9 in the channel unit 30 assimilates the shapes of other channel plates.

Subsequently, a product of the piezoelectric actuator 16 bonded with the channel unit 30 is bonded with the frame 12 as illustrated in FIG. 4C. In this process, the channel unit 30 and the frame 12 may further be closely adhered to each other such that the channel unit 30 forms a recess with respect to the frame 12. Hence, the bonding strength may be increased. In this case, it may be possible to suppress ink leakage between the frame 12 and the channel unit 30. Further, since the frame 12 having high rigidity is bonded with the channel unit 30, the inflection points 37 may be bonded in accordance with the frame 12.

Related Art Liquid-Ejection Head

Figure 8:
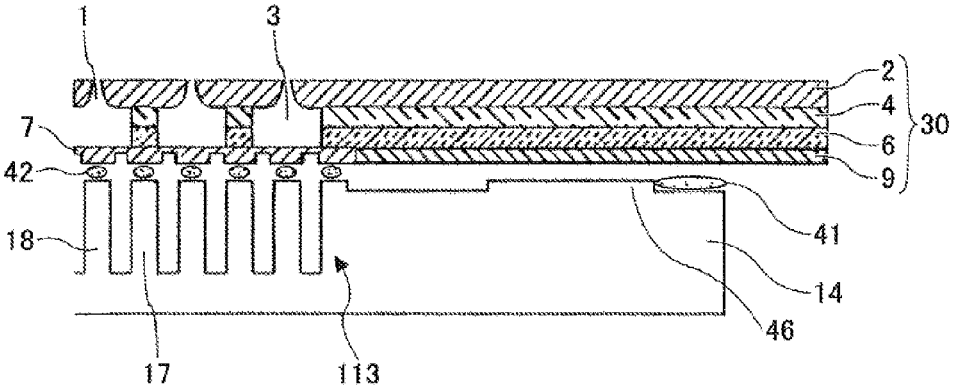
FIG. 8 is a schematic diagram illustrating an example of a bonding configuration of a piezoelectric element in a related-art liquid-ejection head.

Next, an illustration is given of a related art liquid-ejection head. FIG. 8 illustrates a bonding structure of a diaphragm 7, a diaphragm plate 9, and a piezoelectric element 14. In FIG. 8, there is provided a gap between the piezoelectric element 14 and the diaphragm plate 9 for convenience of illustration. In the following illustration, an area in which the pressure liquid chamber 3 is formed, and from which ink is ejected may be referred to as an ink-ejection channel area.

FIG. 8 depicts the channel unit 30, the pressure liquid chamber 3, the piezoelectric element 14, fast-curing adhesive 41, a projection part 46, and bonding adhesive 42. In FIG. 8, the bonding adhesive 42 is used to adhere the piezoelectric element 14 in the ink-ejection channel area and the diaphragm 7. The bonding adhesive 42 needs longer time for curing. Hence, the fast-curing adhesive 41 is applied to an end face of the piezoelectric element 14 to temporarily fix the piezoelectric element 14 and the diaphragm 7. When the piezoelectric element 14 and the diaphragm 7 are not temporarily fixed with fast-curing adhesive 41, the displacement may occur between the piezoelectric element 14 and the diaphragm 7, which may further lead to liquid ejection failure.

Note that in the configuration using the bonding adhesive and the fast-curing adhesive 41, curing failure may be observed when the bonding adhesive 42 is mixed with the fast-curing adhesive 41. Hence, the projection part 46 is formed near the end face of the piezoelectric element 14 so that the fast-curing adhesive 41 is retained in an initial adhesive surface to secure the bonding strength as well as preventing the fast-curing adhesive 41 from entering the ink-ejection channel area.

Figure 9:
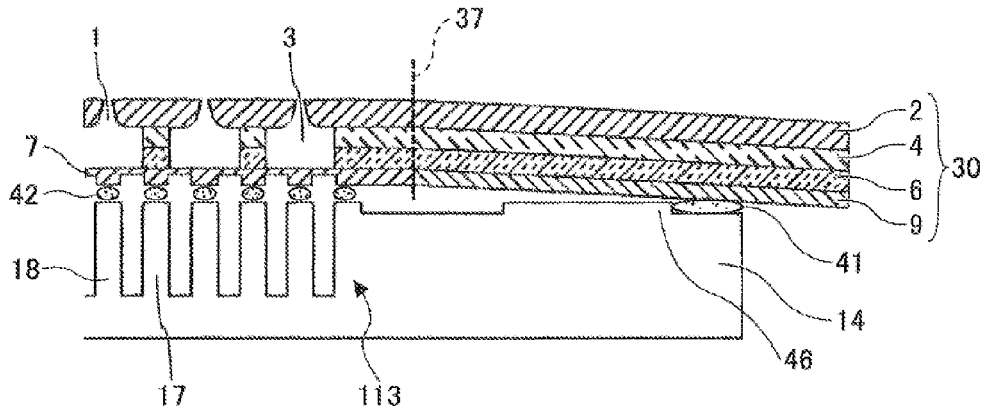
FIG. 9 is a schematic diagram illustrating another example of the bonding configuration of the piezoelectric element in the related-art liquid-ejection head.

However, the channel unit 30 that has warping as illustrated in FIGS. 4A to 4C may need some consideration as noted below. FIG. 9 illustrates a bonding configuration of the diaphragm 7 and the diaphragm plate 9 in a case of the related art piezoelectric element 14 and the channel unit 30 having warping. As illustrated in FIG. 9, the channel unit 30, when bonding, interferes with the projection part 46 of the piezoelectric element 14 in an area outside the inflection point 37. Further, several channels of a drive part 17 at the end face of the piezoelectric element 14 may be affected in the ink-ejection channel area. As a result, bonding pressure may be non-uniform to cause non-uniform bonding. This may cause characteristics variability such as variability in ink droplet ejecting speeds.

Figure 10:
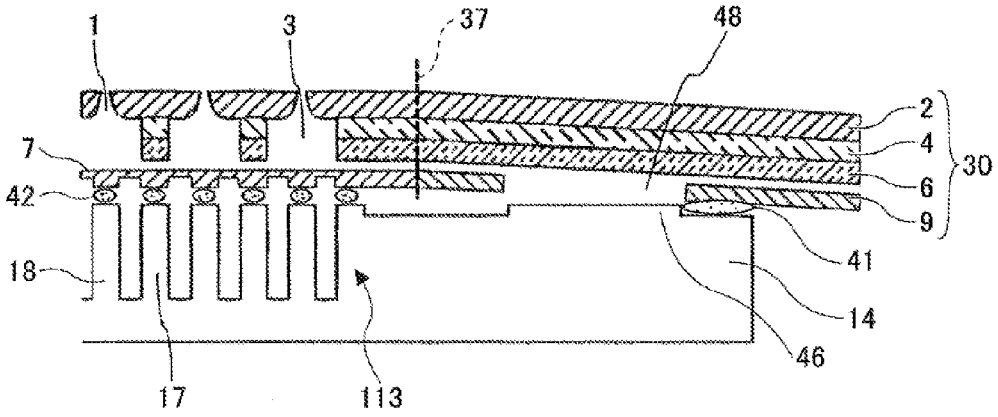
FIG. 10 is a schematic diagram illustrating another example of the bonding configuration of the piezoelectric element in the related-art liquid-ejection head.

FIG. 10 illustrates a configuration example of the related art liquid-ejection head exhibiting the characteristics variability. In the related art technology, a through-hole 48 is formed in the diaphragm plate 9 to serve as undercut with respect to the projection part 46 of the piezoelectric element 14. Note that FIG. 10 depicts a gap provided between the diaphragm plate 9 and the restrictor plate 6 for convenience of illustration. However, in this configuration, when the liquid-ejection head is actually used, load exceeding a prescribed amount may be applied while ink priming, purging, and cleaning. Accordingly, when ink leakage occurs in the layered bonding part of the channel unit 30, ink may enter the piezoelectric actuator 16 due to the through-hole 48 formed in the diaphragm plate 9, which may result in electric failure.

Liquid-Ejection Head of Embodiment

Figure 5:
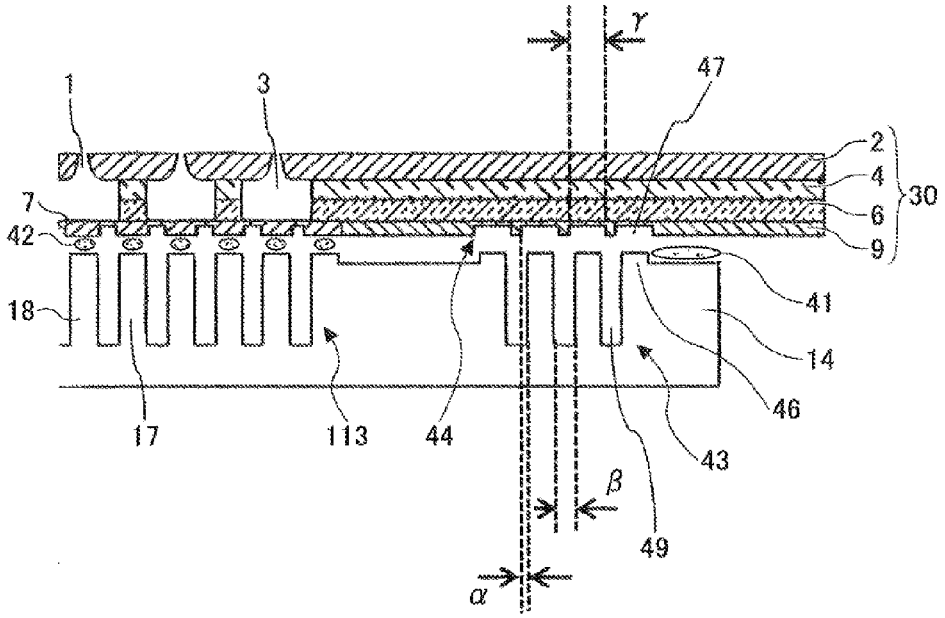
FIG. 5 is a schematic diagram illustrating an example of a bonding configuration of a piezoelectric element of the liquid-ejection head in one embodiment.
Figure 6:
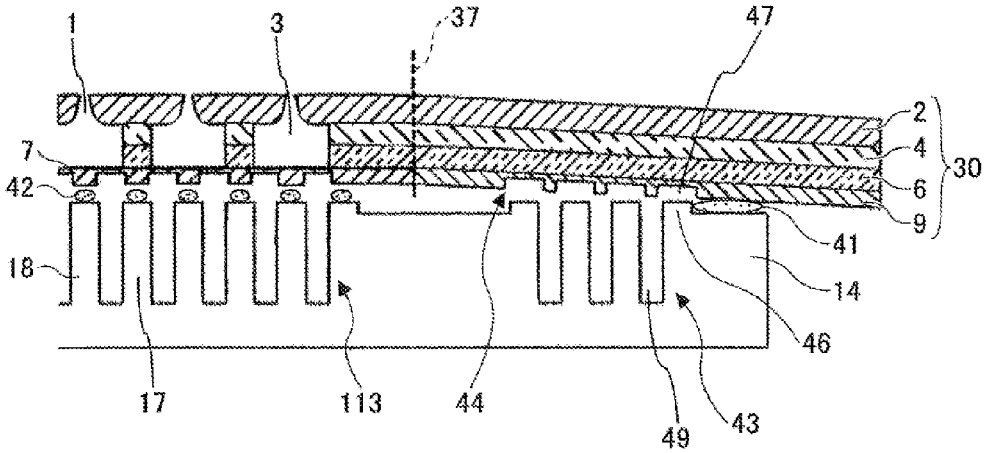
FIG. 6 is a schematic diagram illustrating another example of a bonding configuration of the piezoelectric element in the liquid-ejection head in one embodiment.

FIG. 5 illustrates an example of a bonding structure of the diaphragm 7 and the diaphragm plate 9, and the piezoelectric element 14 in the present embodiment. In FIG. 5, slit parts 43 and 44 are formed in the piezoelectric element 14 and the diaphragm plate 9 at a position toward the end face of the piezoelectric element 14 from the ink-ejection channel area.

In this embodiment, the piezoelectric element 14 includes one or more of the projection parts 46 in an area facing the diaphragm plate 9 and having no pressure liquid chamber 3 disposed, and the diaphragm plate 9 has one or more recess parts 47 fitting in the projection parts 46. Note that as illustrated in FIG. 5, the recess parts 47 of the diaphragm plate 9 do not penetrate the diaphragm plate 9, which differs from the through-hole 48 illustrated in FIG. 10.

In FIG. 5, two or more of the projection parts 46 formed in the piezoelectric element 14 form the slit parts 43, and two or more of the recess parts 47 formed in the diaphragm plate 9 form the slit parts 44. In this case, as illustrated in FIG. 5, since the projection parts 46 fit in the recess parts 47, the slit parts 43 engage with the slit parts 44. Detailed illustration is given later; however, two or more projection parts 46 and two or more recess prats 47 may be preferable but the number of projection parts 46 and the number of recess prats 47 may be one.

In such a configuration, gaps may be formed between the slit parts 43 of the piezoelectric element 14 and the slit parts 44 of the diaphragm plate 9. Hence, it may be possible to prevent the bonding adhesive 42 and the fast-curing adhesive 41 from mixing due to the gaps being formed.

Further, with respect to the example of the channel unit 30 having the warping illustrated in FIGS. 4A to 4C, FIG. 6 illustrates a schematic diagram of the liquid-ejection head of the embodiment having a bonding configuration between the piezoelectric element 14 and the diaphragm plate 9. In this configuration, even when the channel unit 30 has warping, the slit parts 43 and 44 are alternately disposed to form a pectinate structure, which serves as undercut with respect to the warping of the channel unit 30 in an area outside the inflection points 37 affected by the warping. Simultaneously, the fast-curing adhesive 41 may effectively be prevented from interfering with the bonding adhesive 42.

Accordingly, the undercut with respect to the warping of the channel unit 30 may be formed in the actuator bonding step illustrated in FIG. 4B. Hence, the effect of the warping of the channel unit 30 on the ink-ejection channel area may be reduced so as to make the adhesion between the piezoelectric element 14 and the diaphragm 7 homogeneous. As a result, the displacement of the diaphragm 7 may be uniform within the ink-ejection channel area, which may reduce the characteristics variability such as inconsistent ink-ejection speeds according to the ejecting channel locations.

Thus, according to this embodiment, in bonding the diaphragm 7 and the diaphragm plate 9, and the piezoelectric element 14, it may be possible to prevent the bonding adhesive 42 from mixing with the fast-curing adhesive 41, and to make the adhesion between the piezoelectric element 14 at the end face and the diaphragm 7 homogeneous.

A method of forming the projection parts 46 (or the slit parts 43) in the piezoelectric element 14 is not specifically limited. For example, the projection parts 46 (or the slit parts 43) may be formed by slit processing, which performs dicing processing using a dicing saw. A method of forming the recess parts 47 (or the slit parts 44) in the diaphragm plate 9 is not specifically limited. For example, the recess parts 47 (or the slit parts 44) may be formed by forming patterns by etching or electroforming. Among the above-described methods, electroforming may be preferred. In electroforming method, the diaphragm is generally formed in a two-layer structure forming a movable part as a thin film by electroforming in order to efficiently propagate the displacement of the piezoelectric element, and it may be possible to form the diaphragm having the two-layer structure without changing the related art manufacturing processes by setting the interlayer thickness the same as the thickness of thin film.

Next, an illustration is given of a gap formed between the slit part 43 of the piezoelectric element 14 and the slit part 44 of the diaphragm plate 9. As illustrated in FIG. 5, when the gap is represented by $\alpha$, the pectinate width of the piezoelectric element 14 is represented by $\beta$, and the slit width of the diaphragm plate 9 is represented by $\gamma$, a formula $\alpha=(\gamma-\beta)/2$ is established. Note that $\gamma \geq \beta$ in the above formula.

The gap $\alpha$ may be changeable according to the conditions because it is adjustable by the pectinate width $\beta$ of the piezoelectric element 14 and the slit width $\gamma$ of the diaphragm plate 9. For example, the gap $\alpha$ may be set suitable for the viscosity of the fast-curing adhesive 41 so as to optimally prevent the adhesive infiltration. Thus, the above-described $\alpha$, $\beta$, and $\gamma$ values are not specifically limited. However, when these values are the same as the width of the split groove 113 in ink-ejection channel area for forming the slit part 43 of the piezoelectric element 14, the slit is formed under a processing condition similar to the groove processing condition in the ink-ejection channel area.

The diaphragm plate 9 is frequently formed in a layered structure alternately forming a thick film part and a thin film part in this order with respect to the piezoelectric element 14 directions so as to efficiently propagate the displacement of the piezoelectric elements 14. The thin film part serves as a movable part of the diaphragm plate 9, and is formed as an outermost layer on the piezoelectric element 14 side. In this case, it is preferable that the recess parts 47 be formed in the thin film part. Further, in this case, it is preferable that the depth of the recess part 47 be less than the thickness of the thin film part. Accordingly, the bonding structure of the diaphragm 7 and the diaphragm plate 9, and the piezoelectric element 14 may be produced without changing the related art manufacturing process.

Further, the relationship between the height of the projection part 46 in the piezoelectric element 14 and the depth of the recess part 47 in the diaphragm plate 9 is not particularly limited, and may be appropriately changeable in accordance with conditions. Hence, the height of the projection part 46 may be greater than or less than the depth of the recess part 47.

In the example of FIG. 5, a trough 49 is formed adjacent to each of the projection parts 46 in the piezoelectric element 14. However, in this embodiment, the troughs 49 are not necessarily formed, and may be formed optionally. The troughs 49 are frequently formed in a preparatory stage for forming the projection parts 46. Hence, it is preferable to form the troughs 49 because the troughs 49 facilitate forming the projection parts 46. Note that the depth of the trough 49 is not specifically limited; however, the depth of the trough 49 may be preferably less than the thickness of the piezoelectric element 14.

Figure 7:
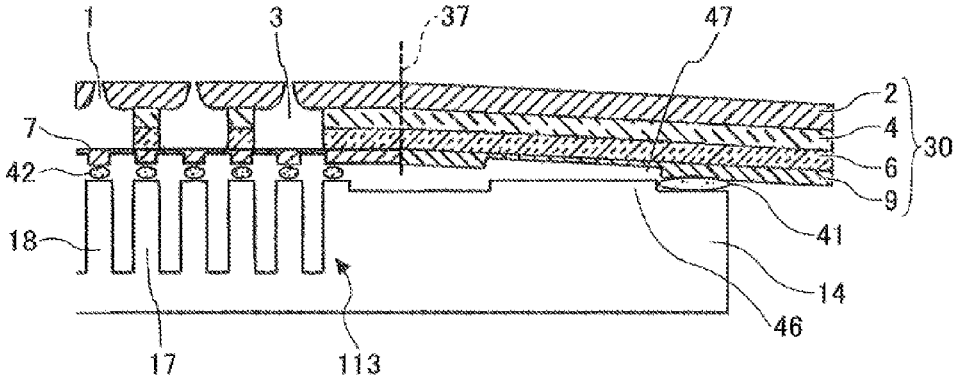
FIG. 7 is a schematic diagram illustrating another example of the bonding configuration of a piezoelectric element in the liquid-ejection head in one embodiment.

FIG. 7 illustrates another example of the bonding structure of the diaphragm 7 and the diaphragm plate 9, and the piezoelectric element 14 in the present embodiment. As illustrated in FIG. 7, the bonding structure may be formed such that one projection part 46 may be formed near an end part of the piezoelectric element 14, and one recess part 47 may be formed on the diaphragm plate 9 side. In this case, the recess part 47 serves as undercut of the projection part 46.

In this case, it is preferable that the width of the recess part 47 be formed broadly, because the narrowly formed projection part 46 may lower the effect in preventing the fast-curing adhesive 41 from entering (mixing). The formation of the recess part 47 indicates the formation of a rectangle hole layer of the thin film in a wider area of the diaphragm plate 9. Hence, pressure is not applied to the rectangle hole layer of the thin film. Thus, the width of the projection part 46 may appropriately be adjusted based on the bonding state of the piezoelectric element 14 and the diaphragm plate 9.

Further, a description is given of the adhesives employed in the embodiment. The fast-curing adhesive 41 is not specifically limited, and any publically known fast-curing adhesive may be used. For example, instantaneous adhesive may be used. In addition, light curing type adhesive such as ultraviolet curing adhesive may be used as the fast-curing adhesive 41. Specifically, the ultraviolet curing adhesive used as the fast-curing adhesive 41 may be cured in a short time. The bonding adhesive 42 is not specifically limited, and any publically known bonding adhesive may be used. For example, epoxy adhesive may be used as the bonding adhesive 42.

Image Forming Apparatus

Figure 11:
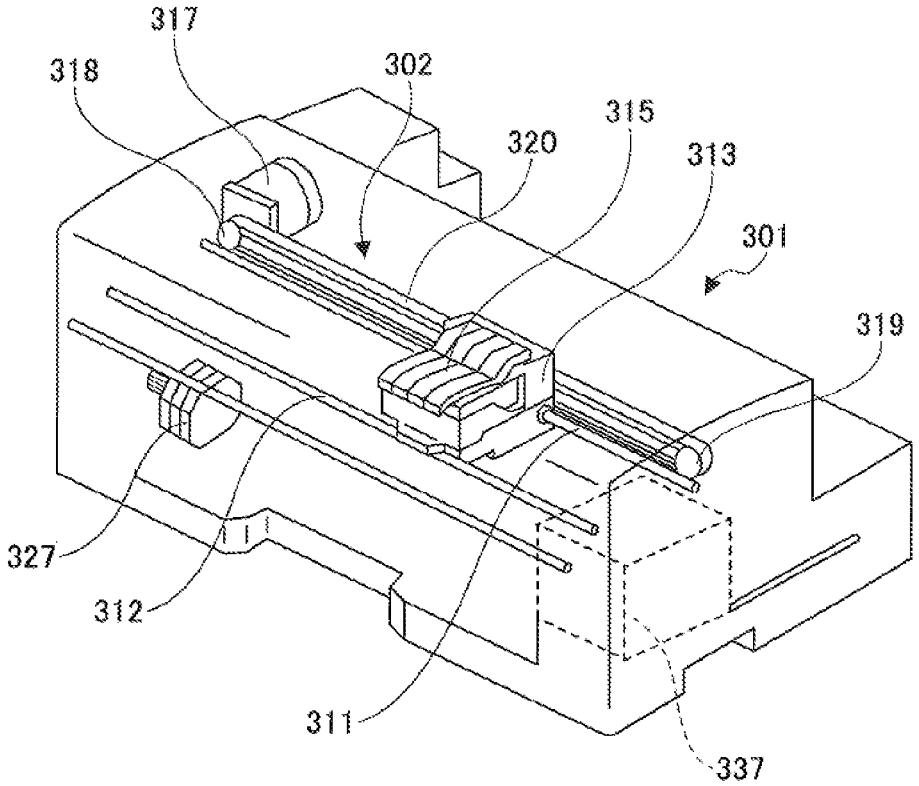
FIG. 11 is an outlined perspective diagram illustrating an example of an image forming apparatus according to an embodiment.
Figure 12:
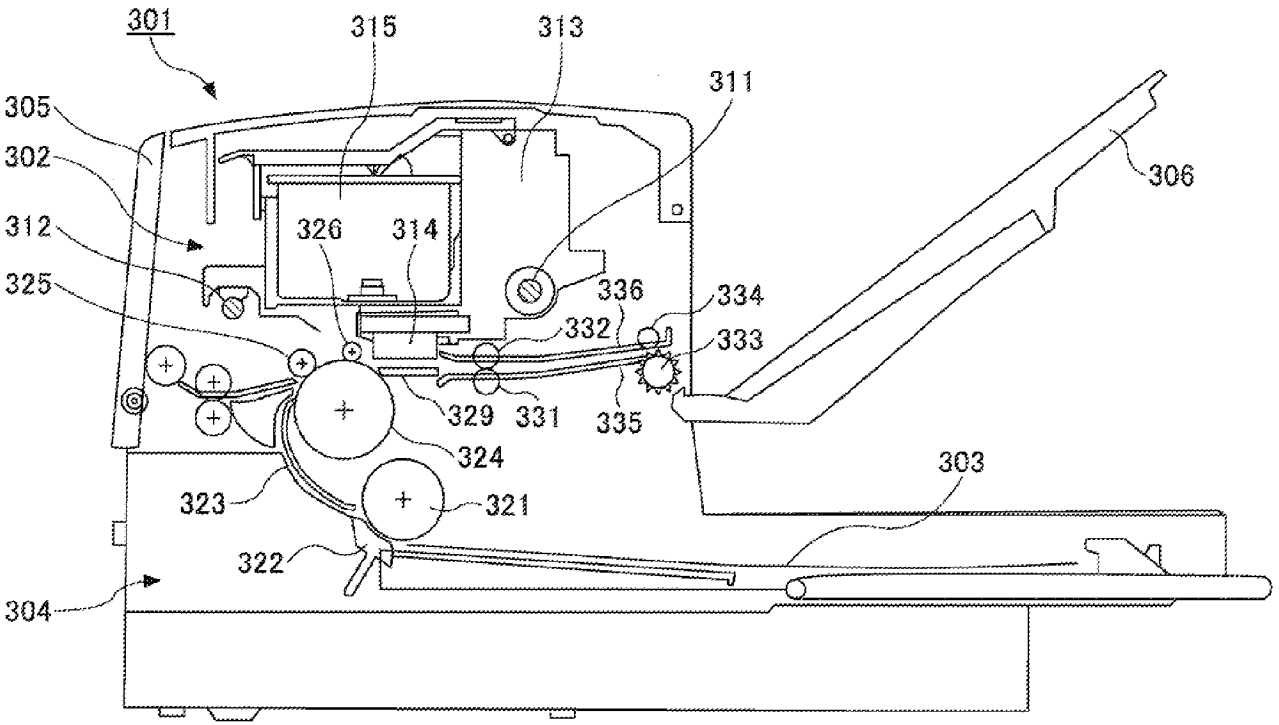
FIG. 12 is an outlined sectional diagram illustrating an example of the image forming apparatus according to the embodiment.

In the following, an illustration is given of an example of an image forming apparatus having the above-described liquid-ejection heads with reference to FIGS. 11 to 12. FIG. 11 is an outlined perspective diagram illustrating an example of an image forming apparatus according to an embodiment, and FIG. 12 is an outlined sectional diagram illustrating an internal configuration of the image forming apparatus according to the embodiment.

The image forming apparatus includes a carriage movable in a main scanning direction inside an apparatus body 301, liquid-ejection heads mounted on the carriage, a print mechanical part 302 composed of ink cartridges and the like configured to supply ink to the liquid-ejection heads, a circuit board having a control circuit for driving motors or applying drive signals based on recording signals to piezoelectric elements of the liquid-ejection heads, and the like. The image forming apparatus further includes a removable paper feeding cassette (or paper feeding tray) 304 under the apparatus body 301. The paper feeding cassette 304 is configured to receive multiple sheets 303 from a front side of the apparatus body 301. The image forming apparatus further includes a manual feed tray 305 flipped to manually feed sheets 303, such that the image forming apparatus receives the sheets 303 fed from the paper feeding cassette 304 or the manual feed tray 305, records desired images by the print mechanical part 302, and then ejects the sheets 303 onto a paper ejection tray 306 attached to a rear side of the image forming apparatus.

The print mechanical part 302 is configured to slidably hold a carriage 313 in the main-scanning direction (a direction perpendicular to paper in FIG. 12) by a main-guide rod 311 and a sub-guide rod 312 that are laterally bridged between not-illustrated left and right side plates. The carriage 313 includes liquid-ejection heads 314 of the embodiment for ejecting ink droplets of different colors of cyan (C), magenta (M), yellow (Y), and black (K), and ink-ejection directions of the liquid-ejection heads 314 are downward. Further, the carriage 313 includes respective removable ink cartridges 315 configured to supply respective colors of ink to the liquid-ejection heads 314. Note that the carriage may include one liquid-ejection head configured to eject ink droplets of CMYK colors.

The upper part of each ink cartridge 315 includes an air opening in communication with the air, and the lower part of the ink cartridge 315 includes an ink supply port configured to supply ink to the liquid-ejection heads 314. The ink cartridge 315 further includes a porous body filled with ink. In this case, ink to be supplied to the liquid-ejection heads 314 is maintained at slightly negative pressure by capillary force of the porous body.

Note that a rear side (downstream of a paper conveyance direction) of the carriage 313 is slidably fitted to the main guide rod 311, and a front side (upstream of the paper conveyance direction) of the carriage 89 is slidably fitted to the sub-guide rod 312. In order to cause the carriage 313 to move and scan in the main-scanning direction, a timing belt 320 is looped between a driving pulley 318 and a driven pulley 319 that are rotationally driven by a main scanning motor 317. After the timing belt 320 is fixed to the carriage 315, the carriage 315 is reciprocally driven by turning the main-scanning motor 317 in normal and reverse directions.

On the other hand, in order to convey the sheets 303 set in the paper feeding cassette 304 to a downstream side of the liquid-ejection head 314, the image forming apparatus includes a paper feeding roller 321 and a friction pad 322 configured to separate and feed each sheet 303 from the paper feeding cassette 304, a guide member 323 configured to guide the sheet 303, a conveyance roller 324 configured to reverse the fed sheet 303 and convey the reversed sheet 303, a conveyance rolling device 325 configured to press a peripheral surface of the conveyance roller 324, and a tip rolling device 326 configured to regulate an angle of the sheet 303 conveyed from the conveyance roller 324. The conveyance roller 324 is configured to rotationally be driven by a sub-scanning motor 327 via a gear array.

The image forming apparatus further includes a print receiving member 329 serving as a sheet guide member configured to guide the sheet 303 conveyed from the conveyance roller 324 at a lower side of the liquid-ejection heads 314 corresponding to a moving range of the carriage 313 in the main-scanning direction. The image forming apparatus further includes a conveyance rolling device 331 and a spur 332 at a downstream side in the paper conveyance direction such that the conveyance rolling device 331 and the spur 332 are rotationally driven to convey the sheet 303 in a paper ejection direction. The image forming apparatus further includes a paper ejection roller 333 and a spur 334 that are configured to convey the sheet 303 to the paper ejection tray 306, and guide members 335 and 336 that form a paper ejection channel.

When the image forming apparatus performs printing, the control circuit drives the liquid-ejection heads 314 based on image signals while moving the carriage 313 such that the liquid-ejection heads 314 deposit ink on the stopped sheet 303 to record one line on the sheet 303, and then record a next line on the sheet 303 after the sheet 303 is conveyed in a predetermined distance. When the image forming apparatus finishes printing, or the control circuit receives a signal indicating that a rear end of the sheet 303 has reached a recording area, the image forming apparatus terminates a recording operation, and ejects the sheet 303.

Further, the image forming apparatus further includes a restoration device 337 located off the recording area on the right end of the carriage 313 moving direction, and configured to restore the liquid-ejection heads 314 that exhibits ejecting failure. The restoration device 337 includes a capping device, a suction device, and a cleaning device. The carriage 313 in a print standby mode is moved toward the restoration device 337 so that ink-ejection ports of the liquid-ejection heads 314 are capped by the capping device so as to maintain the ink-ejection ports in a wetted status. Hence, the ejecting failure of the liquid-ejection heads 314 due to dried ink may be prevented. Further, ink viscosity may be maintained at a predetermined level for all the nozzles by ejecting ink unassociated with recording while performing recording operations. Hence, stable ejecting performance may be maintained.

When liquid ejection failure has occurred, the ink-ejection ports of the liquid-ejection heads 314 are sealed by the capping device, bubbles and the like are suctioned together with ink by the suction device from the nozzles through tubes. Then, ink or dust adhered around the ink-ejection ports is removed by the cleaning device so as to resolve ink eject failure. Further, the suctioned ink is discharged into a waste ink reservoir disposed at a lower part of a main body, and the discharged ink is absorbed and held by an ink absorber inside the waster ink reservoir.

According to the embodiments, there is provided a liquid-ejection head capable of preventing bonding adhesive from mixing with fast-curing adhesive for bonding a diaphragm, a substrate having the diaphragm, and piezoelectric elements, and preventing bonding heterogeneity between the piezoelectric elements and the diaphragm disposed near an end part of a pressure liquid chamber.

The present invention is not limited to the specifically disclosed embodiments, and variations and modifications may be made without departing from the scope of the present invention.

The present application is based on and claims the benefit of priority of Japanese Priority Application No. 2014-206565 filed on Oct. 7, 2014, the entire contents of which are hereby incorporated herein by reference.

What is claimed is:

1. A liquid-ejection head for ejecting liquid droplets, the liquid-ejection head comprising:

a substrate having a diaphragm forming a part of walls of a pressure liquid chamber; and a piezoelectric element adhered to the substrate with adhesive, and configured to apply pressure to the pressure liquid chamber via the diaphragm, wherein the piezoelectric element has a surface facing the substrate having the diaphragm, and the surface has one or more projection parts in an area in which the pressure liquid chamber is not disposed, and whereon the substrate having the diaphragm has one or more recess parts that fit in the respective projection parts.

2. The liquid-ejection head as claimed in claim 1, wherein the piezoelectric element has two or more projection parts, and the substrate having the diaphragm has two or more recess parts.

3. The liquid-ejection head as claimed in claim 1, wherein the projection parts are formed by performing dicing processing on the piezoelectric element.

4. The liquid-ejection head as claimed in claim 1, wherein the substrate having the diaphragm forms a thick film part and a thin film part in this order with respect to the piezoelectric element direction, and the recess parts are formed in the thin film part.

5. The liquid-ejection head as claimed in claim 1, wherein the substrate having the diaphragm is formed by electroforming.

6. The liquid-ejection head as claimed in claim 1, comprising:

a plurality of members formed in layers, and at least one of the members is formed by press-processing a metallic plate.

7. An image forming apparatus comprising: the liquid-ejection head as claimed in claim 1.

* * * * *